US007604462B2

(12) United States Patent
Inoue

(10) Patent No.: US 7,604,462 B2
(45) Date of Patent: Oct. 20, 2009

(54) HIGH PRESSURE PUMP HAVING PLUNGER

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/289,495

(22) Filed: Oct. 29, 2008

(65) Prior Publication Data

US 2009/0104045 A1 Apr. 23, 2009

Related U.S. Application Data

(62) Division of application No. 11/324,329, filed on Jan. 4, 2006.

(30) Foreign Application Priority Data

Jan. 19, 2005 (JP) ..... 2005-011503

(51) Int. Cl.
*F04B 49/06* (2006.01)

(52) U.S. Cl. ..... 417/53; 417/439; 417/470; 417/485; 417/542

(58) Field of Classification Search ..... 417/254, 417/255, 439, 470, 485, 505, 540, 542, 571; 123/447, 495, 499, 506, 507, 508
See application file for complete search history.

(56) References Cited

U.S. PATENT DOCUMENTS 28,644 A 6/1860 Bean
838,887 A 12/1906 Nagel
2,811,931 A * 11/1957 Everett ..... 417/265
4,515,530 A 5/1985 Christoleit
6,116,870 A 9/2000 Kraemer
6,554,590 B2 * 4/2003 Maeda et al. ..... 417/505
7,198,033 B2 * 4/2007 Inaguma et al. ..... 123/506
7,354,255 B1 4/2008 Lishanski et al.
7,373,924 B1 5/2008 Krengel et al.

(Continued)

FOREIGN PATENT DOCUMENTS

JP 54-122214 8/1979

(Continued)

OTHER PUBLICATIONS

Office Action dated Jan. 22, 2009 issued in corresponding U.S. Appl. No. 11/324,329.

(Continued)

*Primary Examiner*—Devon C Kramer
*Assistant Examiner*—Bryan Lettman
(74) *Attorney, Agent, or Firm*—Nixon & Vanderhye P.C.

(57) ABSTRACT

A high pressure pump draws fluid from a fluid inlet into a compression chamber through an inlet chamber. The high pressure pump has a fluid chamber that communicates with the fluid inlet via the inlet chamber. The high pressure pump includes a plunger and a cylinder. The plunger draws fluid from the inlet chamber into the compression chamber when the plunger moves in a drawing direction. The plunger is capable of pressurizing fluid in the compression chamber when the plunger moves in a pressurizing direction. The cylinder movably supports the plunger therein. When the plunger moves in the drawing direction, fluid in the inlet chamber is drawn into the compression chamber, so that fluid flows from the fluid chamber into the inlet chamber.

6 Claims, 17 Drawing Sheets

U.S. PATENT DOCUMENTS

| | | | | |
|---|---|---|---|---|
| 2003/0017069 | A1 | 1/2003 | Usui et al. | |
| 2004/0096346 | A1 | 5/2004 | Usui et al. | |
| 2009/0068041 | A1 * | 3/2009 | Beardmore | 417/540 |

FOREIGN PATENT DOCUMENTS

| | | |
|---|---|---|
| JP | 11-343945 | 12/1999 |
| JP | 2002-54531 | 2/2002 |

OTHER PUBLICATIONS

Examination Report (w/English translation) for corresponding Chinese Application No. 200610006306.3, dated Sep. 14, 2007.
Japanese Office Action mailed Jun. 11, 2008 issued in corresponding Japanese Appln. No. 2005-011503 with English translation.

* cited by examiner

HIGH PRESSURE PUMP HAVING PLUNGER

CROSS REFERENCE TO RELATED APPLICATIONS

This application is a division of application Ser. No. 11/324,329 filed Jan. 4, 2006, which is in turn based on Japanese Patent Application No. 2005-11503 filed on Jan. 19, 2005, the disclosure of which is incorporated herein by reference.

FIELD OF THE INVENTION

The present invention relates to a high pressure pump that has a plunger. More specifically, the present invention relates to a high pressure pump, in which a plunger moves to draw fuel from an inlet chamber and into a compression chamber, in which fuel is pressurized using the plunger.

BACKGROUND OF THE INVENTION

High pressure pumps are disclosed in JP-A-2002-54531 and JP-A-2003-35239 (US 2003/0017069A1, US 2004/0096346A1). In these high pressure pumps, fuel is introduced from a low pressure pump or the like into an inlet chamber through a fuel inlet. A plunger moves back and forth, thereby pumping fuel from the inlet chamber into a compression chamber.

The plunger downwardly moves in an intake stroke to draw fuel from the inlet chamber into the compression chamber. When an amount of fuel drawn from the inlet chamber into the compression chamber increases in the intake stroke, pressure in the inlet chamber may decrease. In particular, when an amount of fuel discharged from the high pressure pump increases, the plunger may be enlarged in diameter, or the reciprocating stroke of the plunger may increase. In these cases, an amount of fuel, which is drawn from the inlet chamber into the pressurizing camber, may increase. As a result, pressure in the inlet chamber is apt to decrease. In addition, when rotation speed of the high pressure pump increases, speed of reciprocating motion of the plunger increases. In this case, an amount of fuel, which is drawn from the inlet chamber into the compression chamber as the plunger downwardly moves, may exceed an amount of fuel introduced from the low pressure pump into the inlet chamber. As a result, pressure in the inlet chamber is apt to decrease.

In this condition, when pressure in the inlet chamber decreases in the intake stroke as the plunger downwardly moves, fuel may not be sufficiently drawn from the inlet chamber into the compression chamber. Consequently, an amount of fuel discharged from the high pressure pump may become insufficient.

Furthermore, when fuel returns from the compression chamber into the inlet chamber as the plunger upwardly moves, pressure in the inlet chamber may increase. As the plunger repeats reciprocating motion, pressure in the inlet chamber may fluctuate, and may cause pulsation. When an amount of fuel discharged from the high pressure pump increases, or when the number of rotation of the high pressure pump increases, pulsation of pressure in the inlet chamber may be further stimulated. In this condition, fuel may not be sufficiently drawn from the inlet chamber into the compression chamber when pulsation excessively arises in pressure in the inlet chamber. Accordingly, fuel may not be sufficiently supplied from the inlet chamber into the compression chamber. As a result, an amount of fuel discharged from the high pressure pump may be insufficient.

SUMMARY OF THE INVENTION

In view of the foregoing and other problems, it is an object of the present invention to produce a high pressure pump, in which fluid is capable of being sufficiently supplied from an inlet chamber into a compression chamber.

According to one aspect of the present invention, a high pressure pump draws fluid from a fluid inlet into a compression chamber through an inlet chamber. The high pressure pump has a fluid chamber that communicates with the fluid inlet via the inlet chamber. The high pressure pump includes a plunger and a cylinder. The plunger draws fluid from the inlet chamber into the compression chamber when the plunger moves in a drawing direction. The plunger is capable of pressurizing fluid in the compression chamber when the plunger moves in a pressurizing direction. The cylinder movably supports the plunger therein. When the plunger moves in the drawing direction, fluid in the inlet chamber is drawn into the compression chamber, so that fluid flows from the fluid chamber into the inlet chamber.

Alternatively, a high pressure pump draws fluid from a fluid inlet into a compression chamber through an inlet chamber. The high pressure pump has a discharge passage that communicates with the fluid inlet via the inlet chamber. The high pressure pump includes a plunger and a cylinder. The plunger draws fluid from the inlet chamber into the compression chamber when the plunger moves in a drawing direction. The plunger is capable of pressurizing fluid in the compression chamber when the plunger moves in a pressurizing direction. The cylinder movably supports the plunger therein. When the plunger moves in the pressurizing direction, fluid returns from the compression chamber into the inlet chamber, so that fluid is discharged from the inlet chamber through the discharge passage.

Alternatively, a high pressure pump includes a pump housing and a plunger. The pump housing defines a fluid inlet, an inlet chamber, a fluid chamber, and a compression chamber. The fluid inlet communicates with the fluid chamber via the inlet chamber. The inlet chamber is capable of communicating with the compression chamber. The pump housing has a cylinder having an inner space that communicates with the compression chamber. The plunger is movable in the inner space of the cylinder. When the plunger moves in the cylinder along a pressurizing direction, the plunger is capable of pressurizing fluid in the compression chamber. When the plunger moves in the cylinder along a drawing direction, which is substantially opposite to the pressurizing direction, the plunger draws fluid from the fluid inlet into the compression chamber through the inlet chamber, substantially simultaneously with drawing fluid from the fluid chamber into the inlet chamber.

Alternatively, a high pressure pump includes a pump housing and a plunger. The pump housing defines a fluid inlet, an inlet chamber, a fluid chamber, and a compression chamber. The fluid inlet communicates with the fluid chamber via the inlet chamber. The inlet chamber is capable of communicating with the compression chamber. The pump housing has a cylinder having an inner space that communicates with the compression chamber. The plunger is movable in the inner space of the cylinder. The plunger and the cylinder have a sliding part therebetween. The sliding part partitions the fluid chamber from the compression chamber. The compression chamber has a compression volume. The fluid chamber has a fluid volume. The compression volume and the fluid volume have a summation thereof. The summation of the compression volume and the fluid volume is substantially constant.

Alternatively, the inlet chamber has an inlet volume. The compression volume, the fluid volume, and the inlet volume have a summation thereof. The summation of the compression volume, the fluid volume, and the inlet volume is substantially constant.

Thus, an amount of fuel flowing into the compression chamber can be restricted from being excessively insufficient due to decrease in pressure in the inlet chamber. Furthermore, pulsation in pressure of fuel in the inlet chamber may be reduced, so that variation in components can be reduced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1A:
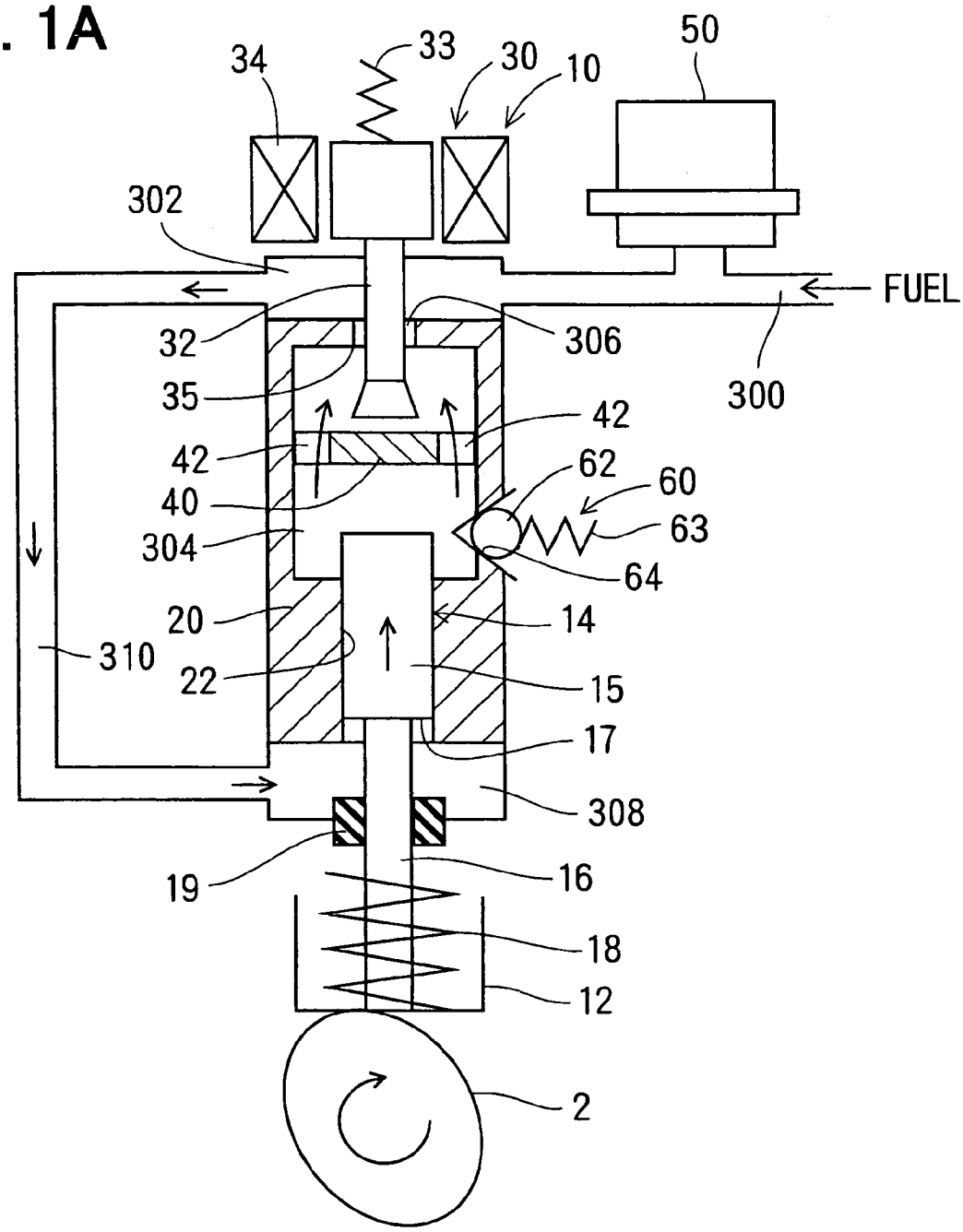
FIG. 1A is a schematic cross sectional side view showing a high pressure pump.

As shown in FIG. 1A, a high pressure pump 10 supplies fuel into an injector of an internal combustion engine such as a diesel engine and a gasoline engine, for example. A plunger 14 has a sliding portion 15 and a small diameter portion 16. The plunger 14 has a nonuniform diameter structure. Specifically, the small diameter portion 16 has the diameter that is less than the diameter of the sliding portion 15. The sliding portion 15 and the small diameter portion 16 have a step 17 therebetween. The sliding portion 15 is supported slidably in a cylinder 22. The small diameter portion 16 is arranged on the opposite side of a compression chamber 304 with respect to the sliding portion 15. The periphery of the small diameter portion 16 is sealed with an oil seal 19. The oil seal 19 serves as a sealing member. The small diameter portion 16 of the plunger 14 makes contact with a tappet 12. The tappet 12 is biased onto the cam 2 by resiliency of a spring 18, so that the bottom surface of the tappet 12 slides on the cam 2 as the cam 2 rotates. Therefore, the plunger 14 reciprocates together with the tappet 12 as the cam 2 rotates.

A pump housing 20 has a cylinder 22 that supports the plunger 14 such that the plunger 14 is capable of moving back and forth in the cylinder 22. The pump housing 20 has an inlet passage (fluid inlet) 300, an inlet chamber 302, the compression chamber 304, a fuel chamber (fluid chamber) 308, and a communication passage 310. Fuel is supplied from a low pressure pump into the inlet chamber 302 of the high pressure pump 10 through the inlet passage 300. The inlet passage 300 serves as a fuel passage.

The inlet chamber 302 communicates with the compression chamber 304 through a communication hole 306 in a condition where a valve member (plug) 32 is lifted from a valve seat 35 in a control valve 30. The communication hole 306 is formed in the inner circumferential periphery of the valve seat 35 of the control valve 30. The fuel chamber 308 is partitioned from the compression chamber 304 via a sliding part between the sliding portion 15 and the cylinder 22. The fuel chamber 308 is a lower space formed on the lower side of the step 17. The fuel chamber 308 is formed around the small diameter portion 16 in a space between the sliding part, which is formed between the sliding portion 15 and the cylinder 22, and the oil seal 19. The upper side of the fuel chamber 308 is tightly sealed via the sliding part between the sliding portion 15 and the cylinder 22. The inlet chamber 302 communicates with a fuel chamber 308 through a communication passage 310. The communication chamber 310 is a discharge passage, through which fuel is discharged from the inlet chamber 302 into the fuel chamber 308.

The control valve 30 is constructed of the valve member 32, the spring 33, a coil 34, the valve seat 35, and a stopper 40. The stopper 40 is arranged on the downstream side of fuel with respect to the valve member 32 in an intake stroke shown in FIG. 2.

Figure 1B:
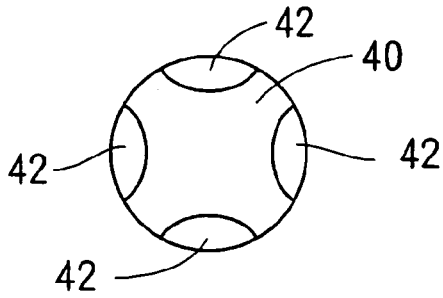
FIG. 1B is a schematic bottom view showing a stopper of a control valve when the stopper being viewed from the side of a plunger, according to a first embodiment of the present invention.

As shown in FIG. 1B, the outer periphery of the stopper 40 has four notches, so that the stopper 40 and the inner circumferential periphery of the pump housing 20 form fuel passages 42 therebetween. The valve member 32 is biased to the side of the stopper 40 by resiliency of the spring 33. That is, the valve member 32 is biased such that the valve member 32 is lifted from the valve seat 35. When the coil 34 is supplied with electricity, the valve member 32 is seated on the valve seat 35 by magnetic attractive force against resiliency of the spring 33. When the valve member 32 is seated on the valve seat 35, the communication hole 306 is blocked, so that the inlet chamber 302 is blocked from the compression chamber 304.

A low pressure damper 50 has a damping member such as a diaphragm therein, thereby reducing pulsation in the inlet passage 300 and the inlet chamber 302. A discharge valve 60 has a ball 62 that is lifted from a seat 64 against resiliency of the spring 63, when pressure in the compression chamber 304 becomes greater than predetermined set pressure. When the ball 62 is lifted from the seat 64, fuel in the compression chamber 304 is discharged from the discharge valve 60.

Next, an operation of the high pressure pump 10 is described.

First, an intake stroke is described.

Figure 2:
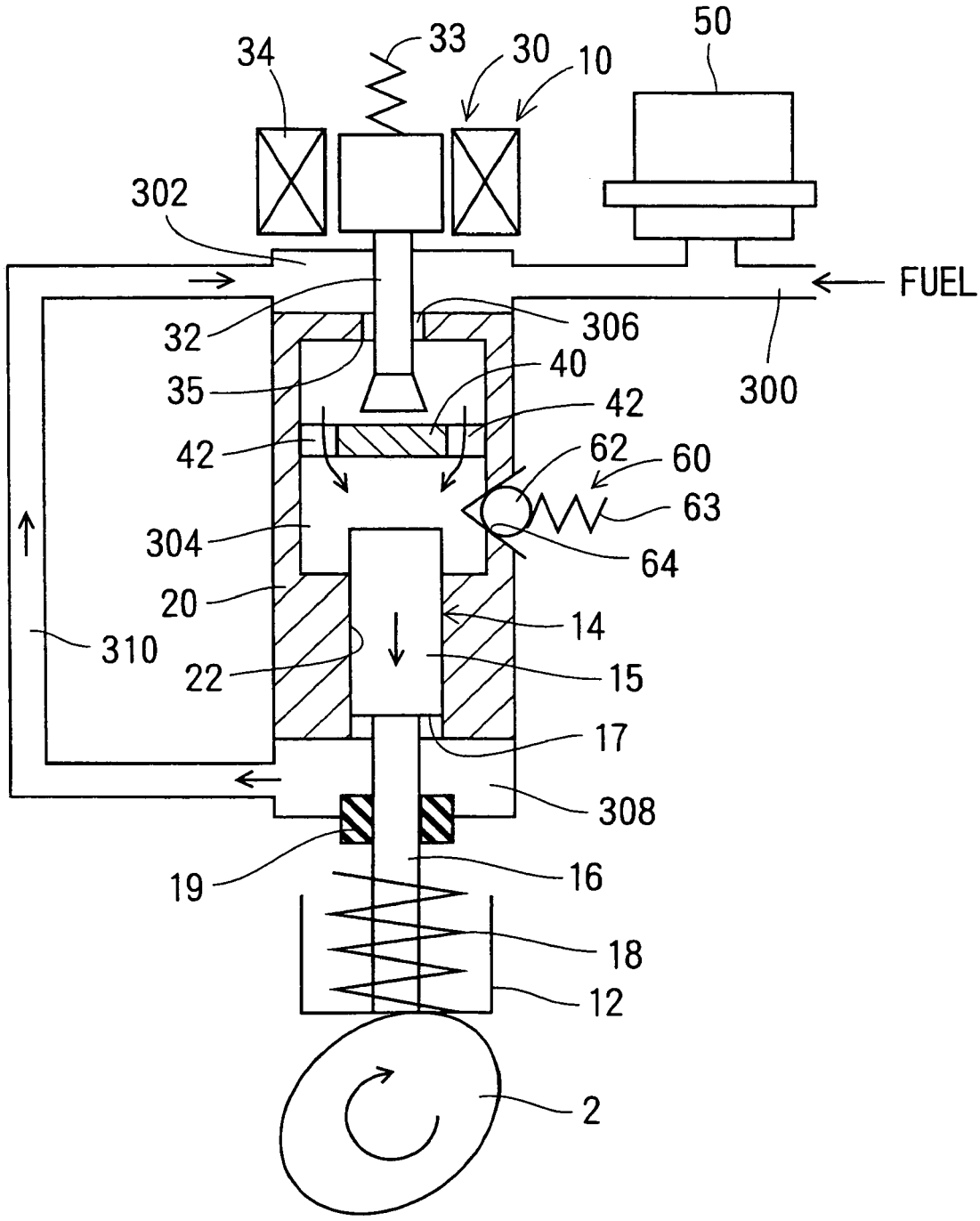
FIG. 2 is a schematic cross sectional side view showing the high pressure pump in an intake stroke, according to the first embodiment.

As shown in FIG. 2, the plunger 14 downwardly moves from the top dead center thereof to the bottom dead center thereof as the cam 2 rotates. In this condition, supplying electricity to the coil 34 is terminated. Therefore, the valve member 32 is lifted from the valve seat 35 downwardly in FIG. 2 by resiliency of the spring 33, so that the inlet chamber 302 communicates with the compression chamber 304 through the communication hole 306. Thus, fuel is drawn from the inlet chamber 302 into the compression chamber 304, as the plunger 14 downwardly moves in a drawing direction.

When the plunger 14 downwardly moves, the step of the plunger 14 formed between the sliding portion 15 and the small diameter portion 16 moves to the side of the fuel chamber 308, so that the volume of the fuel chamber 308 decreases. As the volume of the fuel chamber 308 decreases, fuel in the fuel chamber 308 is pressed into the communication passage 310, so that the fuel is introduced from the communication passage 310 into the inlet chamber 302.

When fuel is drawn from the inlet chamber 302 into the compression chamber 304 as the plunger 14 downwardly moves, fuel is introduced from the fuel chamber 308 into the inlet chamber 302 through the communication passage 310. Therefore, decrease in pressure in the inlet chamber 302 can be decreased in the intake stroke. Thus, an amount of fuel flowing into the compression chamber 304 can be restricted from being insufficient due to decrease in pressure in the inlet chamber 302.

Next, a return stroke is described.

As referred to FIG. 1A, the valve member 32 maintains lifting from the valve seat 35 by resiliency of the spring 33 in a period, in which supplying electricity to the coil 34 is terminated, when the plunger 14 upwardly moves from the bottom dead center thereof to the top dead center thereof. Therefore, fuel in the compression chamber 304 returns into the inlet chamber 302 through the communication hole 306, as the plunger 14 upwardly moves. In this condition, the step 17 formed between the sliding portion 15 and the small diameter portion 16 upwardly moves, so that the volume of the fuel chamber 308 increases. Thus, fuel returning from the compression chamber 304 into the inlet chamber 302 is partially discharged into the fuel chamber 308 through the communication passage 310.

As described above, when fuel returns from the compression chamber 304 into the inlet chamber 302 as the plunger upwardly moves, fuel is discharged from the inlet chamber 302 into the fuel chamber 308 through the communication passage 310. Thus, increase in pressure in the inlet chamber 302 due to upwardly moving of the plunger 14 can be reduced.

Next, a compression stroke is described.

When electricity is supplied to the coil 34 in the return stroke, the valve member 32 is attracted by magnetic attractive force against resiliency of the spring 33, so that the valve member 32 is seated onto the valve seat 35. In this condition, the communication hole 306 is closed, so that the inlet chamber 302 is blocked from the compression chamber 304. Fuel in the compression chamber 304 is pressurized as the plunger 14 upwardly moves in a pressurizing direction, so that pressure of fuel increases in the compression chamber 304. When pressure of fuel in the compression chamber 304 becomes greater than predetermined pressure, the ball 62 is lifted from the seat 34 against resiliency of the spring 63, so that the discharge valve 60 opens the flow passage therein. Thus, fuel pressurized in the compression chamber 304 is discharged from the high pressure pump 10.

A timing, in which electricity is supplied to the coil 34 for opening the control valve 30, is controlled, so that an amount of fuel, which is discharged from the high pressure pump 10 when the plunger 14 upwardly moves, is controlled. The intake stroke, the return stroke, and the compression stroke are repeated, so that the high pressure pump 10 repeats drawing fuel and discharging pressurized fuel.

In this embodiment, as referred to FIG. 2, fuel is introduced from the fuel chamber 308 into the inlet chamber 302 in the intake stroke, so that decrease in pressure of fuel in the inlet chamber 302 is reduced. In this operation, an amount of fuel flowing into the compression chamber 304 can be restricted from being insufficient due to decrease in pressure in the inlet chamber 302, in the intake stroke. Thus, a sufficient amount of fuel can be supplied from the inlet chamber 302 into the compression chamber 304.

In addition, as referred to FIG. 1A, fuel is discharged from the inlet chamber 302 into the fuel chamber 308 in the return stroke, so that increase in pressure of fuel in the inlet chamber 302 can be reduced. In this operation, pulsation, which is caused by repeating moving of the plunger 14 upwardly in FIG. 1A and moving of the plunger 14 downwardly in FIG. 2, can be reduced in the inlet chamber 302. When pulsation in the inlet chamber 302 is reduced, an amount of fuel flowing from the inlet chamber 302 into the compression chamber 304 can be restricted from being insufficient in the intake stroke. Thus, a sufficient amount of fuel can be supplied from the inlet chamber 302 into the compression chamber 304.

Furthermore, pulsation in pressure of fuel in the inlet chamber 302 is reduced, so that variation in pressure applied to a fuel pipe on the side of the low pressure damper 50 and the inlet chamber 302 can be reduced. Therefore, components such as the low pressure damper 50 and the fuel pipe can be protected from being damaged. In addition, vibration in the fuel pipe can be reduced, so that a support member of the fuel pipe can be restricted from being loosened or damaged.

Furthermore, the fuel chamber is formed around the small diameter portion of the plunger using a dead space between the small diameter portion and in the vanity of the cylinder. Therefore, the dead space is efficiently used, so that the high pressure pump can be restricted form being jumboized.

Second, Third, and Fourth Embodiments

Figure 3:
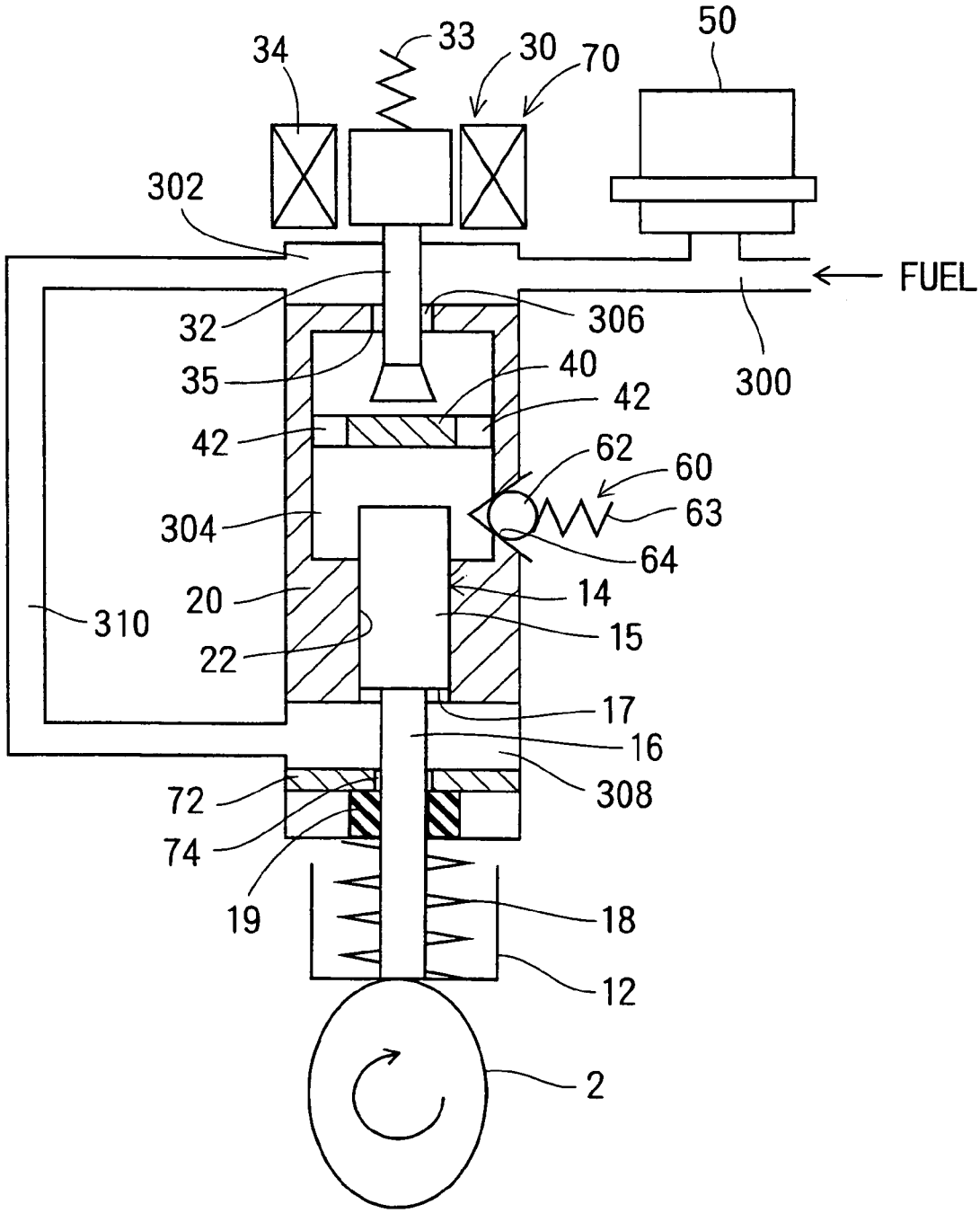
FIG. 3 is a schematic cross sectional side view showing a high pressure pump according to a second embodiment.

As shown in FIG. 3, in a high pressure pump 70 of the second embodiment, an annular plate 72 is provided on the side of the cylinder 22 with respect to the oil seal 19. The annular plate 72 radially surrounds the small diameter portion 16 of the plunger 14. The inner circumferential periphery of the annular plate 72 and the outer circumferential periphery of the small diameter portion 16 form a small gap 74 therebetween, such that the plate 72 does not disturb reciprocation of the small diameter portion 16. In this structure, even when dust is formed in the sliding part between the sliding portion 15 and the cylinder 22 through the sliding operation therebetween, the gap 74 can restrict this dust from intruding into another sliding part between the oil seal 19 and the small diameter portion 16, for example. Thus, the oil seal 19 can be protected from being damaged.

Figure 4:
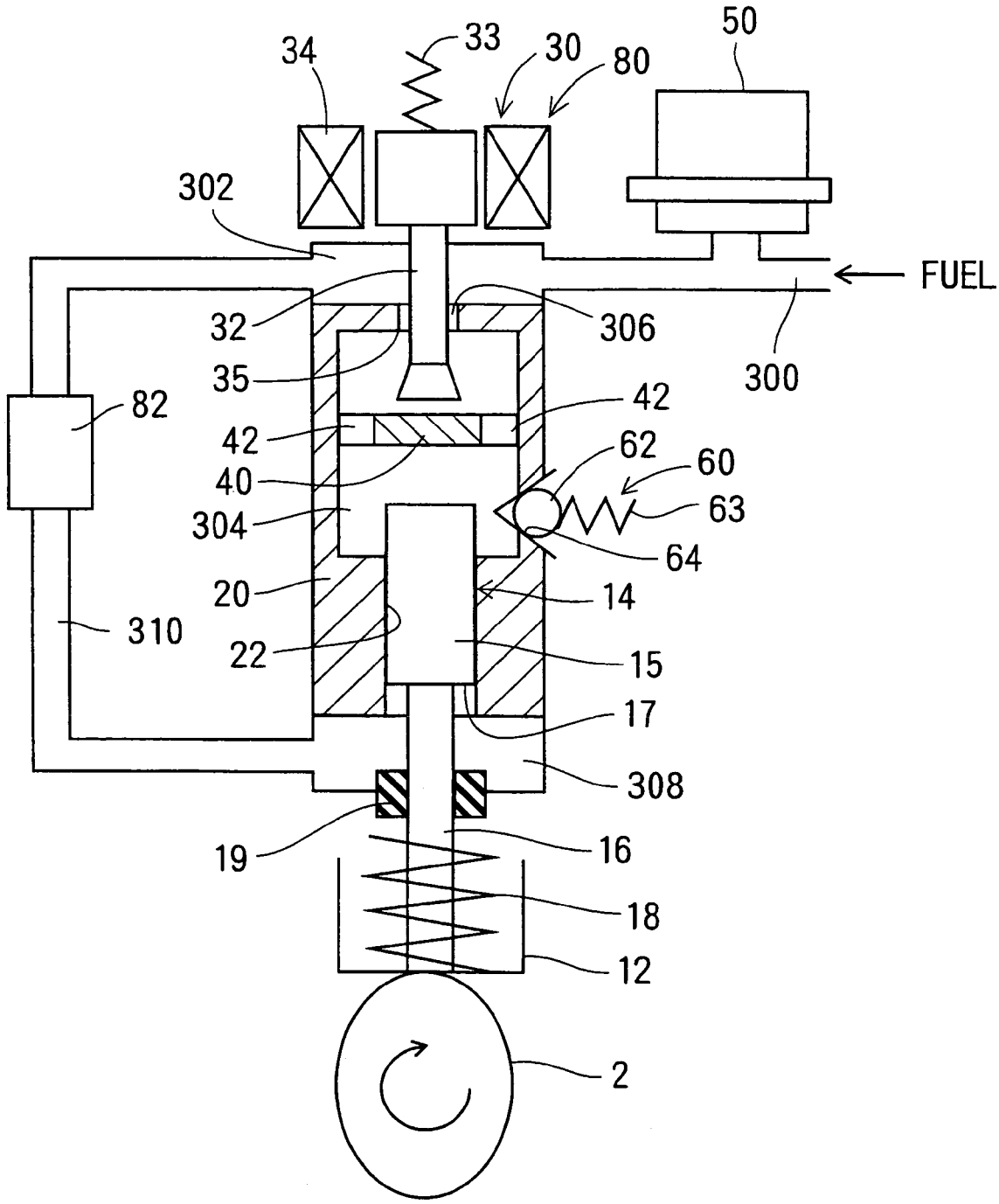
FIG. 4 is a schematic cross sectional side view showing a high pressure pump according to a third embodiment.

As shown in FIG. 4, in a high pressure pump 80 of the third embodiment, a filter 82 is provided midway through the communication passage 310 to remove foreign matters. The filter 82 restricts foreign matters, which is contained in fuel supplied into the high pressure pump 80, from intruding into the sliding part between the oil seal 19 and the small diameter portion 16. In this structure, the oil seal 19 can be protected from being damaged due to intrusion of foreign matters.

Figure 5:
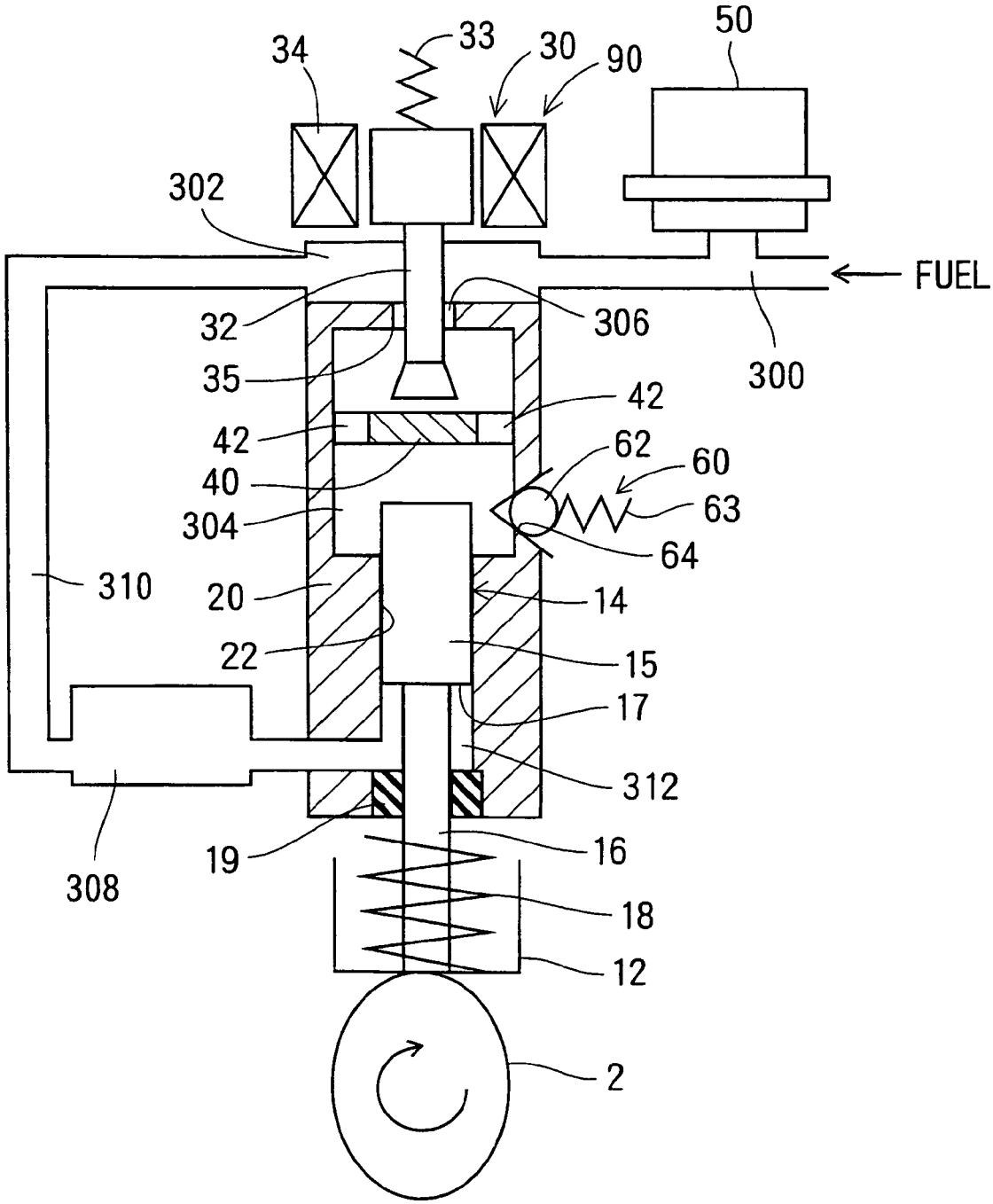
FIG. 5 is a schematic cross sectional side view showing a high pressure pump according to a fourth embodiment.

As shown in FIG. 5, in a high pressure pump 90 of the fourth embodiment, the fuel chamber 308 is formed midway through the communication passage 310, instead of being formed around the small diameter portion 16 of the plunger 14. The fuel chamber 308 communicates with a lower space 312 located on the lower side of the step 17 between the sliding portion 15 and the small diameter portion 16. In this structure, even when the location of the fuel chamber 308 is changed, decrease in pressure of fuel in the inlet chamber 302 can be reduced, and pulsation, which arises in pressure of fuel in the inlet chamber 302 as the plunger 14 reciprocates, can be reduced, similarly to the first embodiment.

Fifth Embodiment

Figure 6:
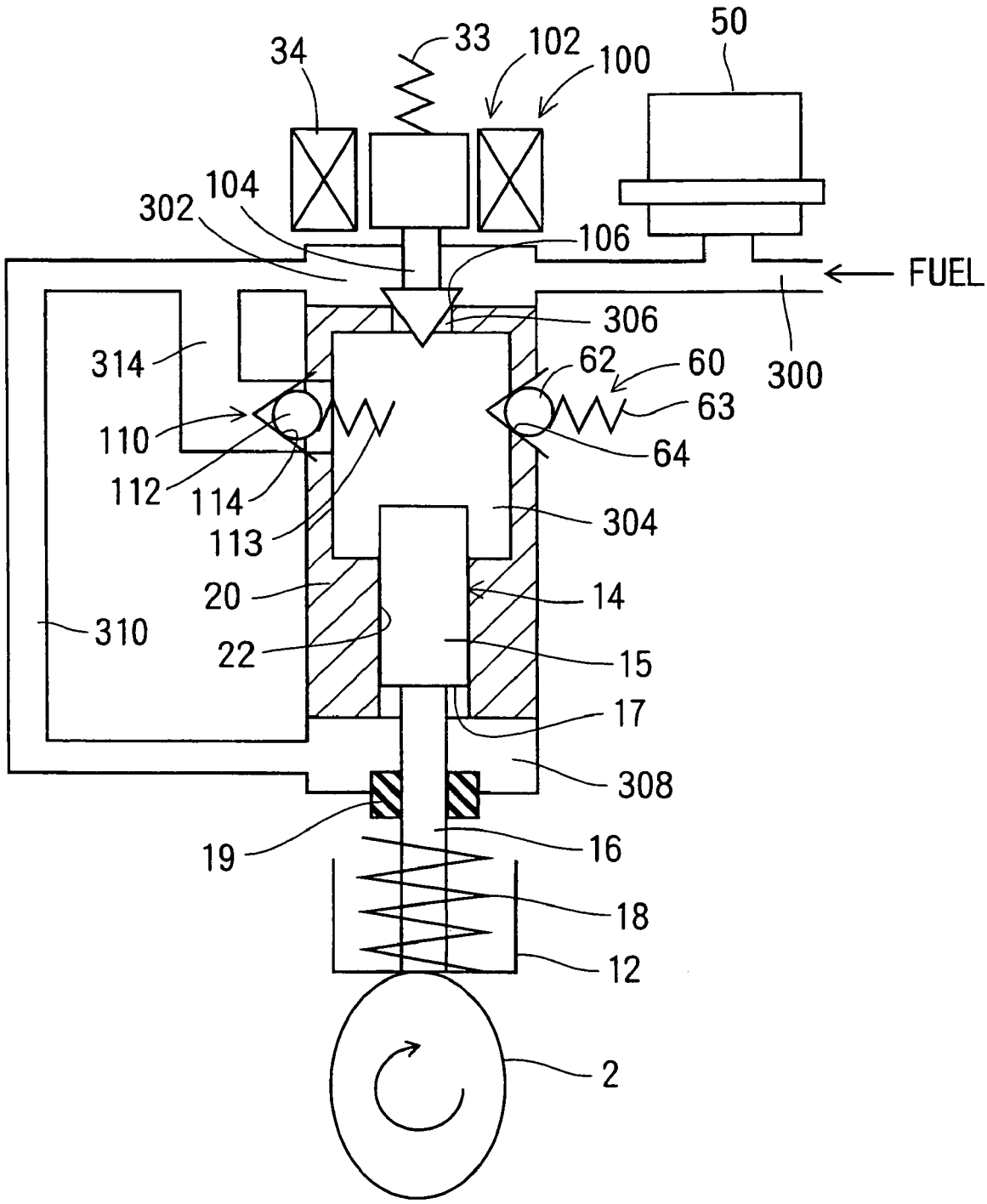
FIG. 6 is a schematic cross sectional side view showing a high pressure pump according to a fifth embodiment.

As shown in FIG. 6, in a high pressure pump 100 of the fifth embodiment, a valve member 104 of a control valve 102 is biased to the valve seat 106 by resilience of the spring 33. When supplying electricity to the coil 34 is terminated, the valve member 104 is seated onto the valve seat 106 by resilience of the spring 33, so that the communication hole 306, which is formed in the inner circumferential periphery of the valve seat 106, is closed. Thus, the inlet chamber 302 is blocked from the compression chamber 304. When electricity is supplied to the coil 34, the valve member 104 is attracted by magnetic attractive force against resiliency of the spring 33, so that the valve member 104 is lifted from the valve seat 106. Thus, the inlet chamber 302 communicates with the compression chamber 304.

An inlet valve 110 is provided in an inlet passage 314 that communicates the inlet chamber 302 with the compression chamber 304. The inlet valve 110 has a ball 112 that is biased by a spring 113 to a seat 114. The inlet valve 110 is a check valve that allows fuel flowing from the inlet chamber 302 into the compression chamber 304, and prohibits fuel from flowing from the compression chamber 304 into the inlet chamber 302.

Next, an operation of the high pressure pump 100 is described.

First, the compression stroke of the high pressure pump 100 is described. When the plunger 14 downwardly moves, and pressure in the compression chamber 304 decreases, the ball 112 of the inlet valve 110 is lifted from the seat 114 against resiliency of the spring 113. In this condition, fuel in the inlet chamber 302 is drawn into the compression chamber 304 through the inlet passage 314. Fuel in the fuel camber 308 is introduced into the inlet chamber 302 through the communication passage 310, as the plunger 14 downwardly moves.

As described above, fuel in the inlet chamber 302 can be drawn into the compression chamber 304 through the inlet valve 110 in the inlet stroke. Therefore, the control valve 102 may be in either an opening condition or in a closing condition.

Next, the returning stroke is described.

When the plunger 14 starts upwardly moving from the bottom dead center thereof to the top dead center thereof in the returning stroke, the coil 34 is supplied with electricity, so that the valve member 32 is lifted from the valve seat 106. In this operation, even when the plunger 14 upwardly moves, fuel in the compression chamber 304 returns into the inlet chamber 302 through the communication hole 306. In addition, the fuel returning into the inlet chamber 302 is supplied into the fuel chamber 308 through the communication passage 310.

Next, the compression stroke is described.

When supplying electricity to the coil 34 is terminated in the return stroke, the valve member 104 is seated onto the valve seat 106 by resiliency of the spring 33, so that the communication hole 306 is closed, and the inlet chamber 302 is blocked from the compression chamber 304. Set pressure, at which the control valve 102 opens, is predetermined to be greater than set pressure, at which the discharge valve 60 opens. As the plunger 14 upwardly moves, when pressure of fuel in the compression chamber 304 becomes greater than the set pressure of the discharge valve 60, the discharge valve 60 opens. In this condition, the control valve 102 maintains closing. Therefore, when the discharge valve 60 opens, fuel pressurized in the compression chamber 304 is discharged from the high pressure pump 100 through the discharge valve 60.

Sixth Embodiment

Figure 7:
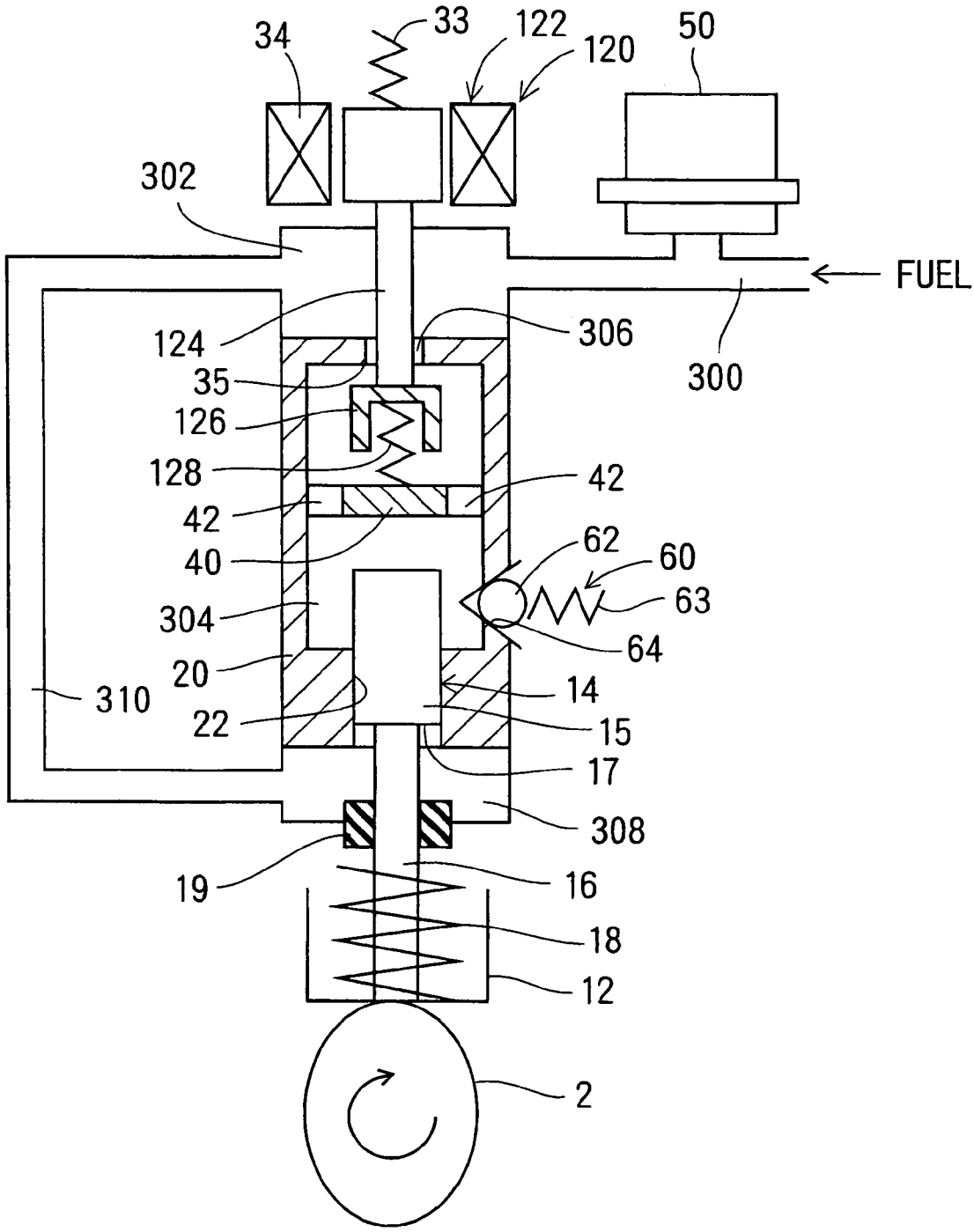
FIG. 7 is a schematic cross sectional side view showing a high pressure pump according to a sixth embodiment.

As shown in FIG. 7, a high pressure pump 120 of the sixth embodiment includes a control valve 122, in which a bottom wall of a cup shaped valve member 126 on the upper side in FIG. 7 connects to a tip end of a shaft 124. A spring 128 biases the valve member 126 in a direction substantially opposite to the direction, in which the spring 33 biases the valve member 126. Resiliency of the spring 33 is set to be greater than resiliency of the spring 128, so that the valve member 126 is lifted from the valve seat 35 when supplying electricity to the coil 34 is terminated.

When the coil 34 is supplied with electricity in a condition where the plunger 14 upwardly moves, the shaft 124 is upwardly attracted by magnetic attractive force generated by the coil 34. In this condition, the valve member 126 is upwardly biased by resiliency of the spring 128 together with the magnetic attractive force of the coil 34, so that the valve member 126 is seated onto the valve seat 35. Thus, fuel in the compression chamber 304 is pressurized.

Seventh Embodiment

Figure 8:
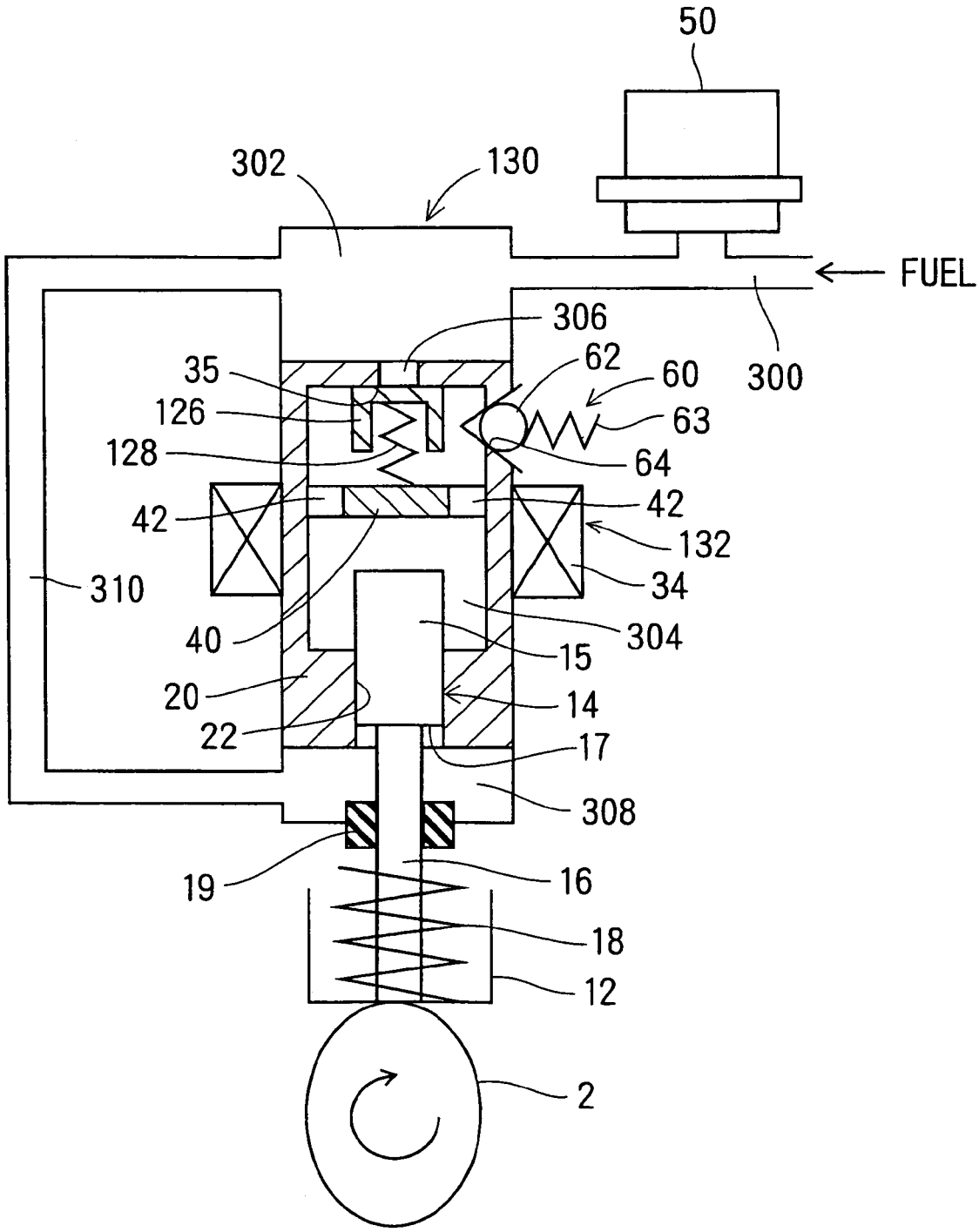
FIG. 8 is a schematic cross sectional side view showing a high pressure pump according to a seventh embodiment.

As shown in FIG. 8, a high pressure pump 130 has a control valve 132, in which the coil 34 is arranged around the outer circumferential periphery of the stopper 40. The stopper 40 is formed of a magnetic material coated with a non-magnetic material, for example. The valve member 126 is formed of a magnetic material, for example. Alternatively, the valve member 126 may be formed of a magnetic material coated with a non-magnetic material, for example.

The spring 128 biases the valve member 126 to the valve seat 35 upwardly in FIG. 8. When electricity is supplied to the coil 34, the valve member 126 and the stopper 40 generate magnetic attractive force therebetween in a direction substantially opposite to the direction, in which the spring 128 biases the valve member 126.

Next, an operation of the high pressure pump 130 is described.

First, the intake stroke of the high pressure pump 130 is described. When the plunger 14 downwardly moves, and pressure in the pressurizing camber 304 decreases, differential pressure between the inlet chamber 302 and the compression chamber 304 changes. This differential pressure is applied to the valve member 126. The inlet chamber 302 is on the upstream side of the valve member 126. The compression chamber 304 is on the downstream side of the valve member 126. In this condition, pressure of fuel in the compression chamber 304 is applied to the valve member 126 as seating force upwardly in FIG. 8 in the direction, in which the valve member 126 is seated onto the valve seat 35. In addition, pressure of fuel in the inlet chamber 302 is applied to the valve member 126 as lifting force downwardly in FIG. 8 in the direction, in which the valve member 126 is lifted from the valve seat 35. When the summation of the seating force and biasing force of the spring 128 applied to the valve member 126 upwardly in FIG. 8 becomes less than the lifting force applied to the valve member 126 downwardly in FIG. 8, the valve member 126 is lifted from the valve seat 35, and moves to the stopper 40. Thus, fuel is drawn from the inlet chamber 302 into the compression chamber 304. Even in a condition where the valve member 126 moves to the stopper 40 and the valve member 126 abuts onto the stopper 40, the fuel passages 42 are formed around the portion, in which the valve member 126 makes contact with the stopper 40. Therefore, fuel is supplied into the compression chamber 304 through the fuel passage 42. The compression chamber 304 is on the opposite side of the valve member 126 with respect to the stopper 40. The coil 34 is supplied with electricity in a condition where the stopper 40 makes contact with the valve member 126 before the plunger 14 reaches the bottom dead center thereof. In this condition, the stopper 40 makes contact with the valve member 126. Therefore, even when magnetic attractive force is small, the control valve 132 can be maintained opening in a condition where the valve member 126 abuts onto the stopper 40.

Next, the return stroke is described.

Electricity supplied to the coil 34 is maintained, so that the stopper 40 and the valve member 126 generate magnetic attractive force therebetween, even when the plunger 14 starts upwardly moving from the bottom dead center thereof to the top dead center thereof.

Therefore, the valve member 126 is maintained abutting onto the stopper 40, so that the valve member 126 maintains opening the communication hole 306. In this operation, fuel is pushed by the plunger 14 as the plunger 14 upwardly moves, and the fuel pushed by the plunger 14 returns into the inlet chamber 302 through the communication hole 306.

Next, the compression stroke is described.

The seating force is applied to the valve member 126 by pressure of fuel in the compression chamber 304 in the direction, in which the valve member 126 is seated onto the valve seat 35. In addition, the lifting force is applied to the valve member 126 by pressure of fuel in the inlet chamber 302 in the direction, in which the valve member 126 is lifted from the valve seat 35.

In this condition, when electricity supplied to the coil 34 stops in the return stroke, the valve member 126 and the stopper 400 stop generating magnetic attractive force therebetween. Therefore, the summation of the seating force applied to the valve member 126 and resiliency of the spring 128 applied upwardly in FIG. 8 becomes greater than the lifting force applied to the valve member 126 downwardly in FIG. 8. Therefore, the valve member 126 is seated onto the valve seat 35 by differential pressure applied to the valve member 126, so that the communication hole 306 is blocked. In this condition, when the plunger 14 further upwardly moves to the top dead center thereof, fuel in the compression chamber 304 is pressurized, so that pressure of fuel increases. When pressure of fuel in the compression chamber 304 becomes greater than a predetermined pressure, the ball 62 is lifted from the seat 64 against resiliency of the spring 63, so that the discharge valve 60 opens the flow passage therein. Thus, fuel pressurized in the compression chamber 304 is discharged from the high pressure pump 130 through the discharge valve 60.

Eighth, Ninth, and Tenth Embodiments

In the eighth, ninth, and tenth embodiments, at least one of the shape of the valve member of the control valve and the shape of the stopper in the high pressure pump is different from those in the seventh embodiment.

Figure 9:
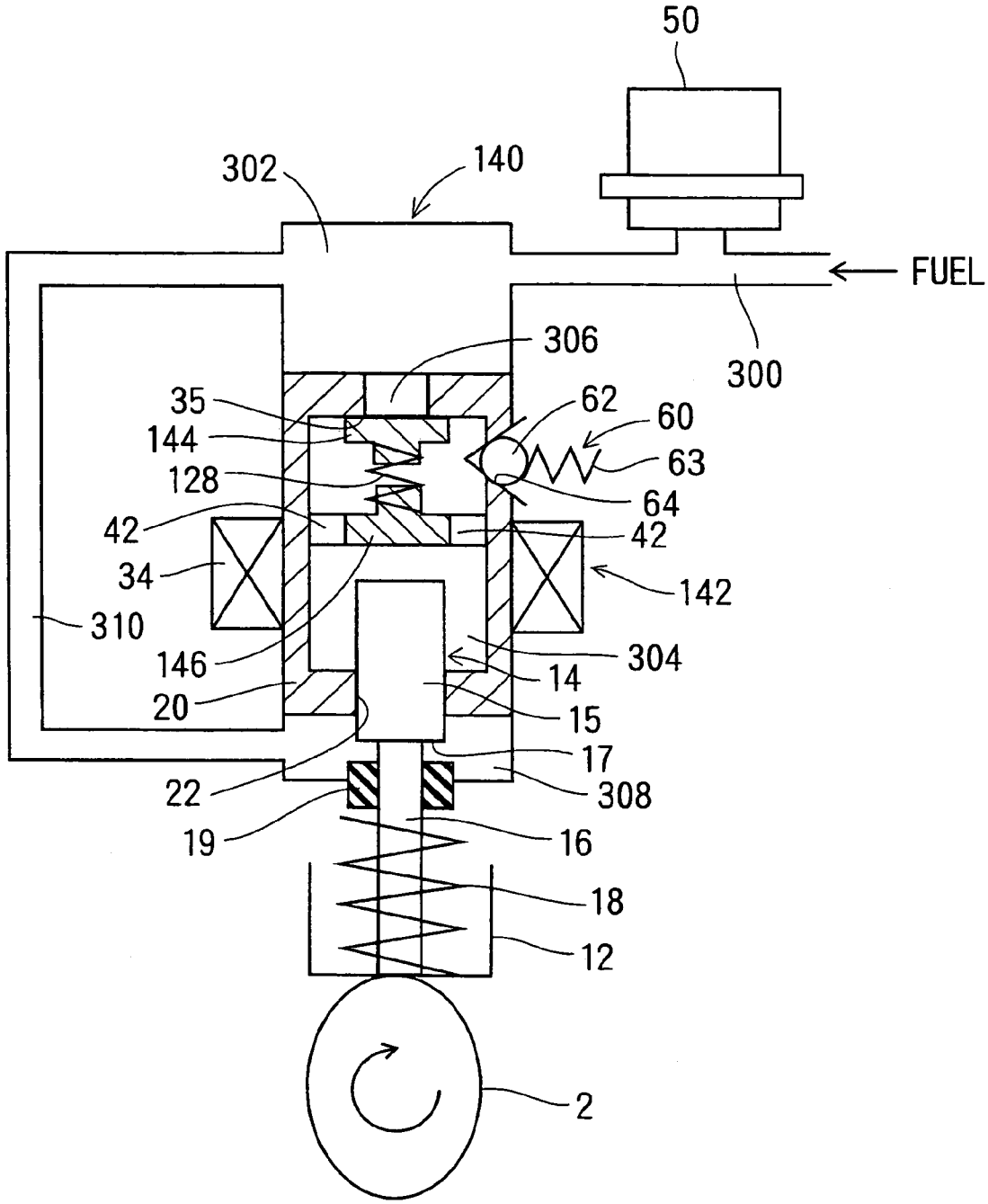
FIG. 9 is a schematic cross sectional side view showing a high pressure pump according to a eighth embodiment.
Figure 10:
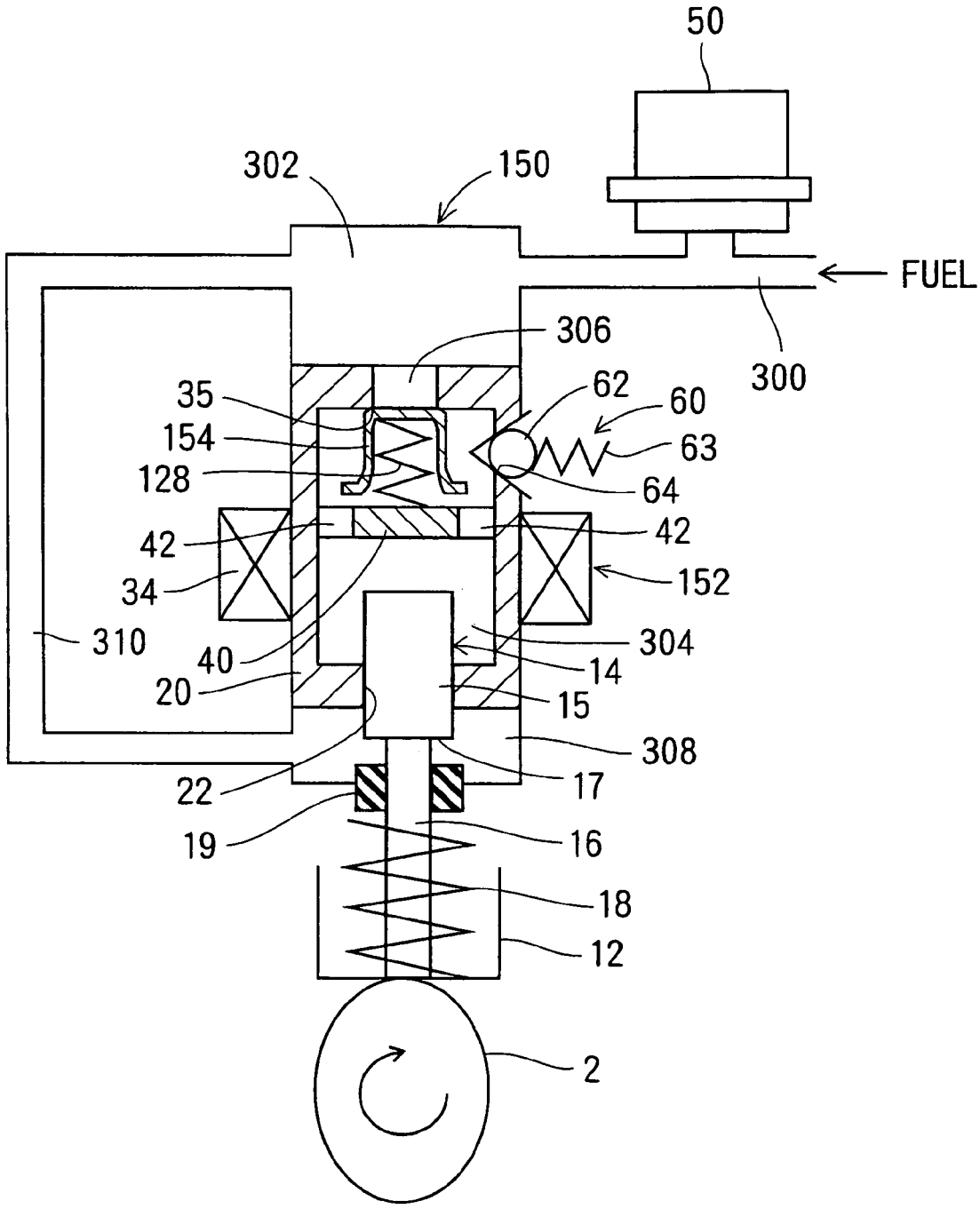
FIG. 10 is a schematic cross sectional side view showing a high pressure pump according to a ninth embodiment.
Figure 11:
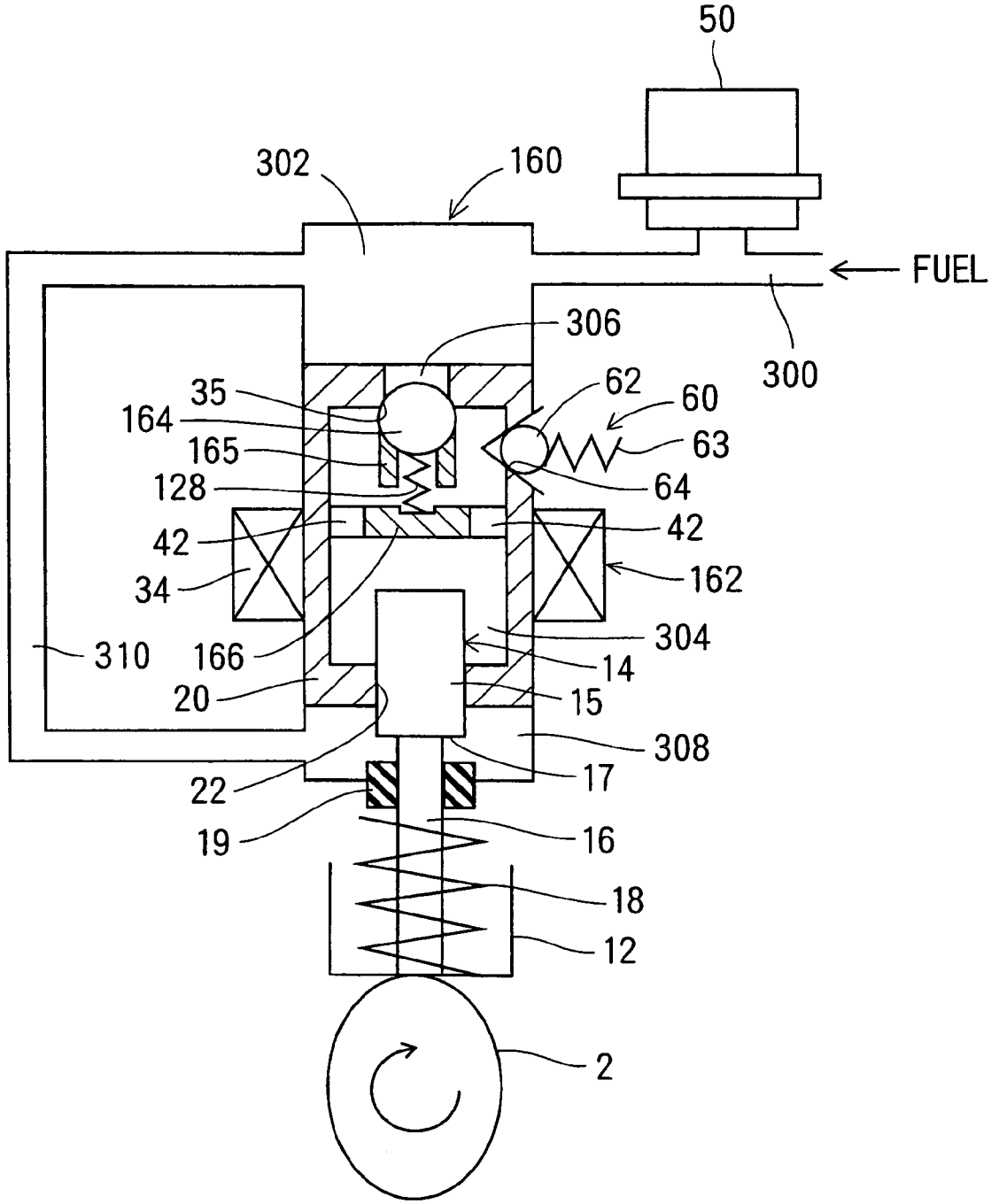
FIG. 11 is a schematic cross sectional side view showing a high pressure pump according to a tenth embodiment.

As shown in FIGS. 9, 10, and 11, stoppers 146, 40, 166 are formed of a magnetic material, which is coated with non-magnetic material, for example. Valve members 144, 154, and a cylindrical member 165 are formed of a magnetic material, for example. Alternatively, the valve members 144, 154, and the cylindrical member 165 may be formed of a magnetic material, which is coated with non-magnetic material, for example. Therefore, as referred to FIG. 9, when the coil 142 is supplied with electricity, the stopper 146 and the valve member 144 generate magnetic attractive force therebetween. In addition, as referred to FIG. 10, when the coil 152 is supplied with electricity, the stopper 40 and the valve member 154 generate magnetic attractive force therebetween. In addition, as referred to FIG. 11, when the coil 162 is supplied with electricity, the stopper 166 and the cylindrical member 165 generate magnetic attractive force therebetween.

As referred to FIG. 9, in a high pressure pump 140 in the eighth embodiment, the stopper 146 of a control valve 142 has a protruding portion, and the valve member 144 has another protruding portion. The protruding portion of the stopper 146 and the protruding portion of the valve member 144 oppose to each other, and are able to make contact with each other.

As referred to FIG. 10, in a high pressure pump 150 in the ninth embodiment, a valve member 154 of a control valve 152 is in a substantially cup shape, which has a flange outwardly extending on the opening side thereof on the lower side in FIG. 10. The valve member 154 opposes to the stopper 40 on the opening side thereof. In this structure, the valve member 154 is capable of abutting onto the stopper 40 via the surface around the flange of the valve member 154. The valve member 154 has the flange, via which the valve member 154 abuts onto the stopper 40, so that the area of the surface, via which the valve member 154 abuts onto the stopper 40, becomes large. Therefore, the valve member 154 can be restricted from being inclined in a condition where the valve member 154 abuts onto the stopper 40.

As referred to FIG. 11, in a high pressure pump 160 in the tenth embodiment, the stopper 166 of a control valve 162 has a recession that receives the spring 128. A ball 164 and the cylindrical member 165 construct the valve members.

Eleventh, Twelfth Embodiment

Figure 12:
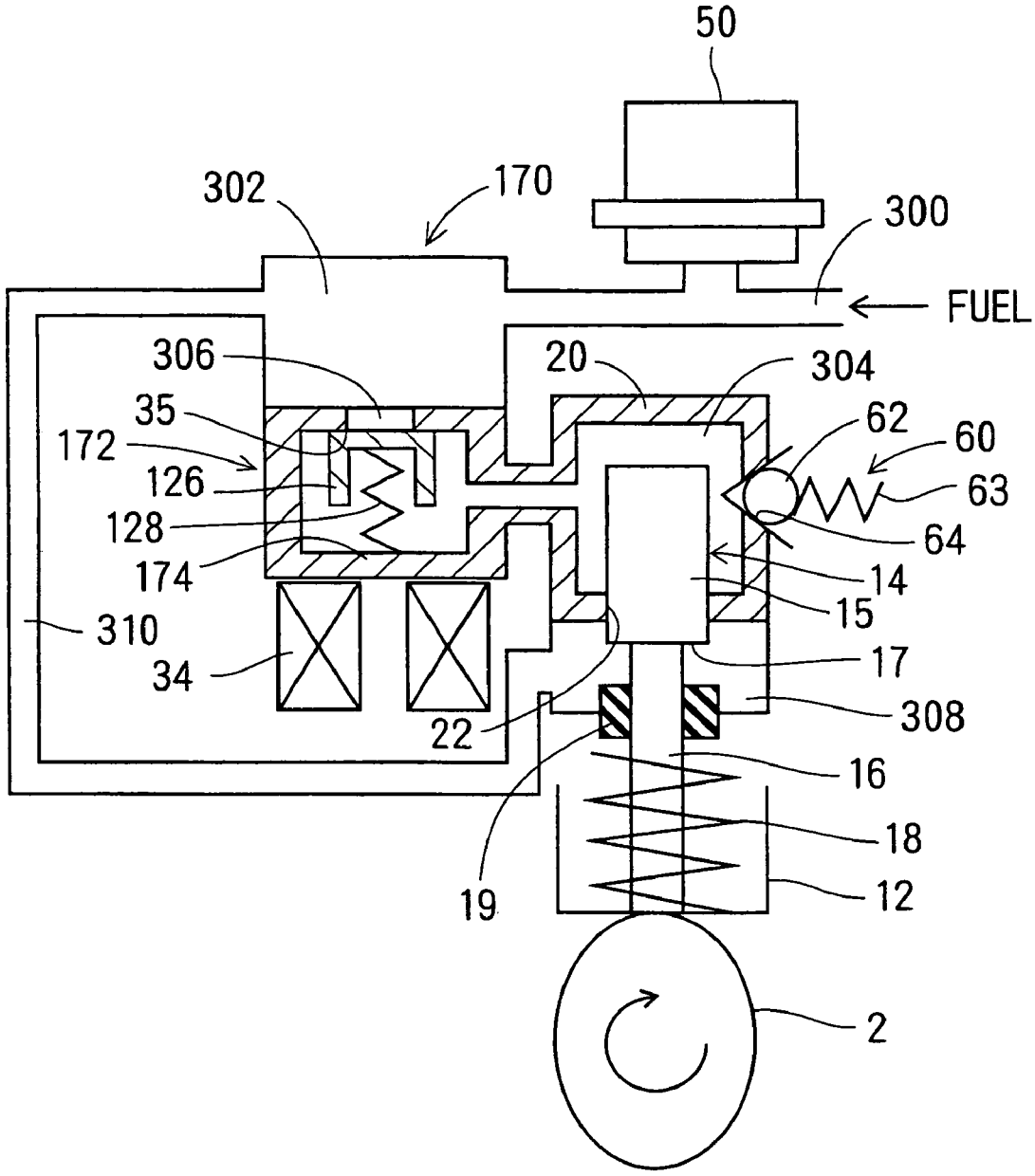
FIG. 12 is a schematic cross sectional side view showing a high pressure pump according to a eleventh embodiment.
Figure 13:
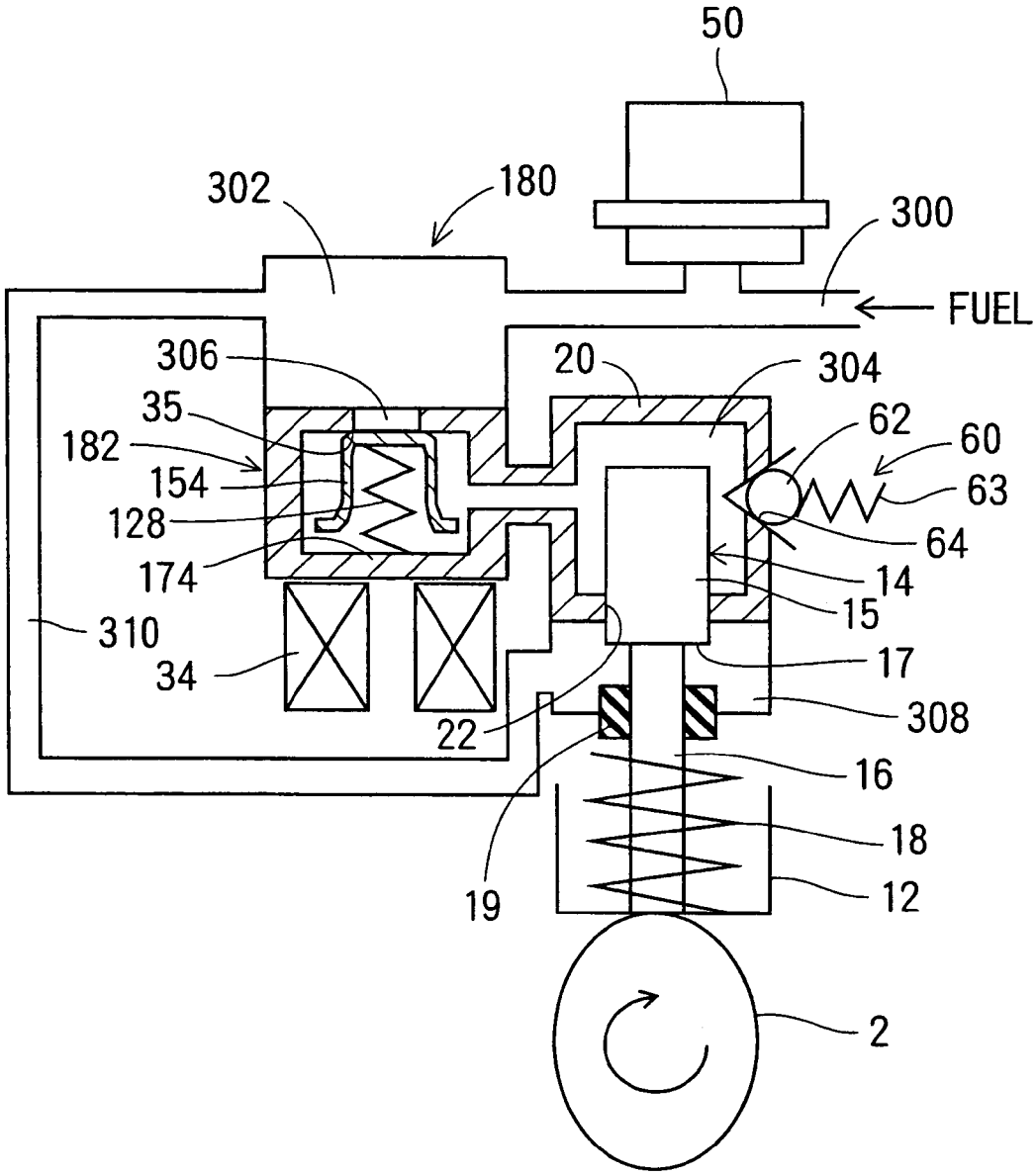
FIG. 13 is a schematic cross sectional side view showing a high pressure pump according to a twelfth embodiment.

As shown in FIGS. 12, 13, in the structures of the eleventh embodiment and the twelfth embodiment, the valve member 126, 154 has shapes different from those in the above embodiments. The operation of the valve member 126, 154 and a timing of supplying electricity to the coil 34 are substantially the same as those in the above seventh to tenth embodiments.

In a high pressure pump 170 of the eleventh embodiment shown in FIG. 12, the axis of a control valve 172 is displaced from the axis of the plunger 14. The valve member 126 of the control valve 172 has a stopper 174, which is integrally formed with the pump housing 20. In this structure, the stopper 174 of the pump housing 20 is formed of a magnetic material, which is coated with non-magnetic material, for example. Therefore, when the coil 34 is supplied with electricity, the valve member 126 and the stopper 174 generate magnetic attractive force therebetween.

In a high pressure pump 180 of the twelfth embodiment shown in FIG. 13, the axis of a control valve 182 is displaced from the axis of the plunger 14. The valve member 154 of a control valve 182 has a stopper 174, which is integrally formed with the pump housing 20. In this structure, the stopper 174 of the pump housing 20 is formed of a magnetic material, which is coated with non-magnetic material, for example. Therefore, when the coil 34 is supplied with electricity, the valve member 154 and the stopper 174 generate magnetic attractive force therebetween.

Thirteenth Embodiment

Figure 14:
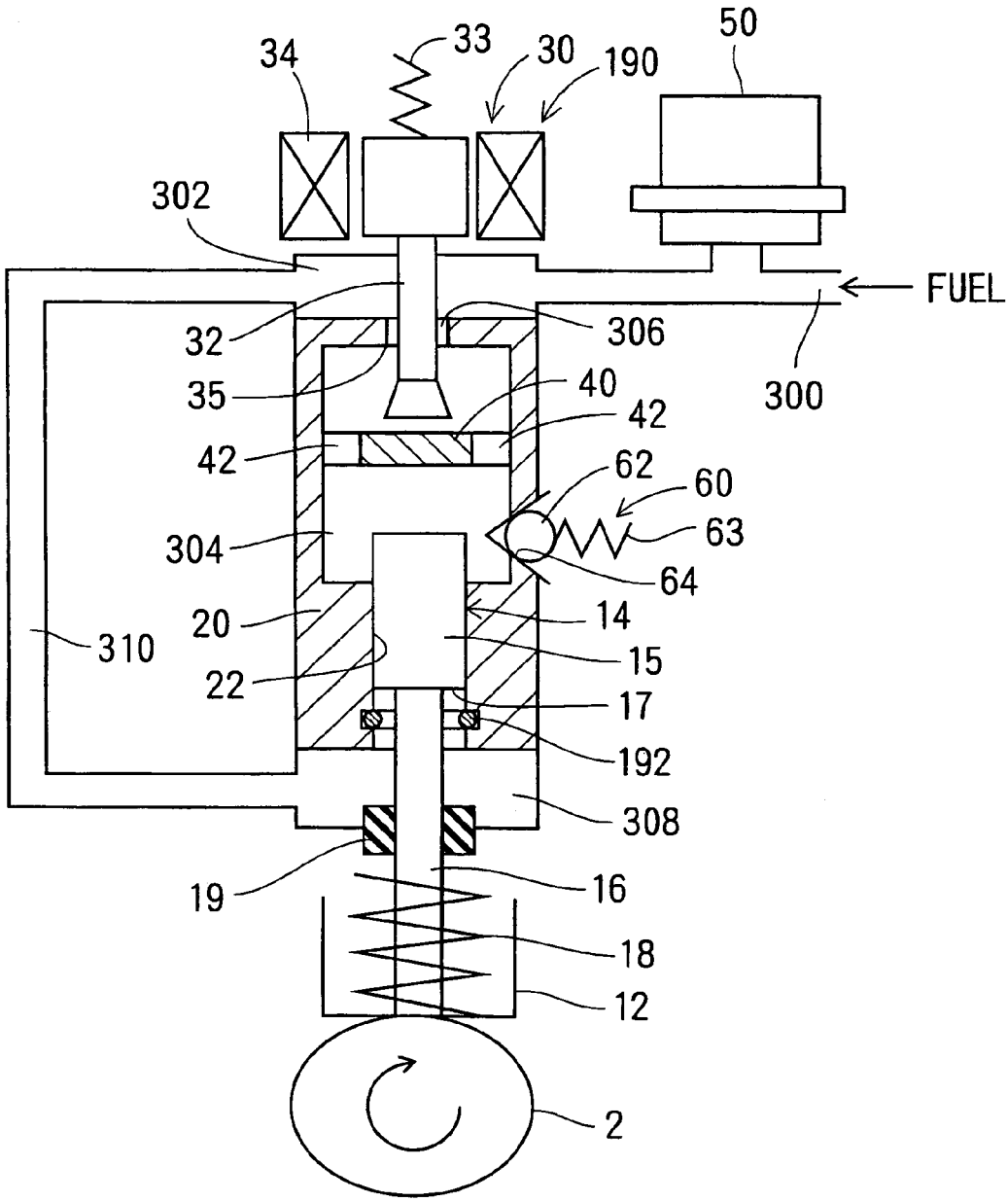
FIG. 14 is a schematic cross sectional side view showing a high pressure pump according to a thirteenth embodiment.
Figure 15:
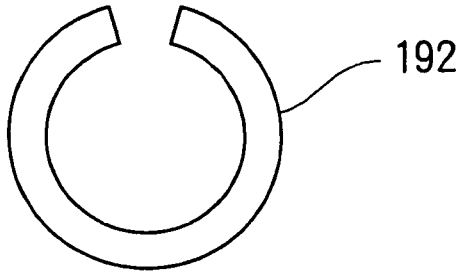
FIG. 15 is a schematic view showing a stopper of the plunger according to the thirteenth embodiment.

As shown in FIG. 14, in a high pressure pump 190 in the thirteen embodiment, a substantially C-shaped stopper 192 shown in FIG. 15 engages with the inner wall of the cylinder 22 on the lower side of the step 17 of the plunger 14. That is, the stopper 192 engages with the inner wall of the cylinder 22 on the side, on which the plunger 14 moves downwardly in FIG. 14, with respect to the step 17 of the plunger 14. Specifically, the stopper 192 is arranged on the side of the tappet 12 with respect to the lowest portion of the step 17 of the plunger 14. The stopper 192 radially protrudes inwardly from the inner circumferential wall of the cylinder 22. In this structure, when the sliding portion 15 of the plunger 14 downwardly moves in a condition where the high pressure pump 190 is detached from the cam 2, the sliding portion 15 hooks to the stopper 192, for example. In this condition, the step 17 of the plunger 14 can be restricted from colliding against the oil seal 19, so that the oil seal 19 can be protected from being damaged.

Figure 16:
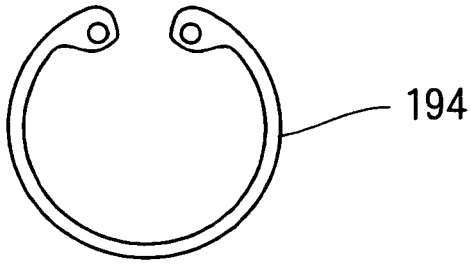
FIG. 16 is a schematic view showing a stopper of the plunger according to a first variation of the thirteenth embodiment.
Figure 17:
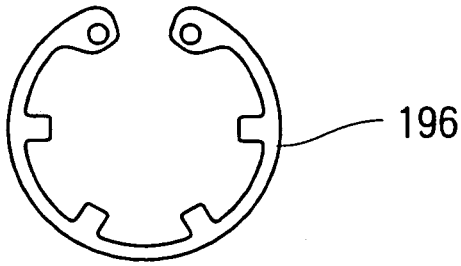
FIG. 17 is a schematic view showing a stopper of the plunger according to a second variation of the thirteenth embodiment.
Figure 18:
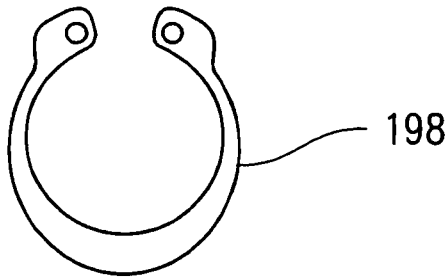
FIG. 18 is a schematic view showing a stopper of the plunger according to a third variation of the thirteenth embodiment.

The step 17 of the plunger 14 may be hooked using stoppers 194, 196, and 198 shown in FIGS. 16, 17, and 18, instead of the stopper 192 in the thirteenth embodiment. Each of the stoppers 194, 196, and 198 is in a substantially C-shape, and is engaged with the inner wall of the cylinder 22 on the side, to which the step 17 of the plunger 14 moves downwardly in FIG. 14. Each of the stoppers 194, 196, and 198 is arranged on the side of the tappet 12 with respect to the lowest portion of the step 17 of the plunger 14.

In the structures of the thirteenth embodiment and the first, second, and third variations of the thirteenth embodiment, each of the stoppers 192, 194, 196, and 198 is arranged on the side of the tappet 12 with respect to the lowest portion of the step 17 of the plunger 14. Thus, when the high pressure pump is attached to and detached from another component such as an engine, the plunger 14 can be restricted from being detached from the high pressure pump, so that an assembling work of the high pressure pump can be facilitated.

In the above embodiments, the fuel chamber is partitioned from the compression chamber 304 via the sliding part between the sliding portion 15 of the plunger 14 and the cylinder 22. The inlet chamber 302 communicates with the fuel chamber through the communication passage 310. Furthermore, the small diameter portion 16 is provided to the sliding portion 15 on the side, to which the sliding portion 15 downwardly moves, so that the step 17 is formed between the sliding portion 15 and the small diameter portion 16.

Therefore, when the plunger 14 downwardly moves, the volume of the fuel chamber arranged on the lower side of the step 17 decreases. That is, when the plunger 14 downwardly moves, the volume of the space on the side, to which the plunger 14 downwardly moves, decreases. Therefore, fuel in the fuel chamber is pushed to the communication passage 310, and is introduced into the inlet chamber 302. Degree of decrease in the volume of the fuel chamber and the space, to which the plunger 14 downwardly moves, corresponds to speed of the plunger, which downwardly moves. Accordingly, even when rotation speed of the high pressure pump increases, and speed of motion of the plunger 14 increases, fuel can be introduced from the fuel chamber into the inlet chamber 302 as the plunger 14 downwardly moves. Thus, in this structure, pressure of fuel in the inlet chamber 302 can be restricted from decreasing in the intake stroke.

Furthermore, when the plunger 14 upwardly moves, and the end surface of the sliding portion 15 of the plunger 14 moves to the side of the compression chamber 304, the volume of the compression chamber 304 decreases. Whereby, fuel returning from the compression chamber 304 into the inlet chamber 302 is pushed into the communication passage 310, and is supplied into the fuel chamber. In this structure, pressure in the inlet chamber 302 can be restricted form increasing in a condition where the plunger 14 upwardly moves. Therefore, pulsation in the inlet chamber 302 can be reduced, even when the pulsation is caused in the inlet chamber 302 as the plunger 14 upwardly and downwardly moves.

In the above structures, pressure in the inlet chamber 302 is restricted from decreasing, and pressure in the inlet chamber 302 is restricted from causing pulsation, so that an amount of fuel flowing from the inlet chamber 302 into the compression chamber 304 can be restricted from being insufficient in the intake stroke. Therefore, a sufficient amount of fuel can be supplied into the pressuring chamber 304. Pulsation in pressure in the inlet chamber 302 can be reduced, so that pressure in the inlet chamber 302 can be restricted from being increased. Therefore, components, which are provided on the side of the fuel inlet, such as the low pressure damper 50 and the fuel pipe can be protected from being damaged due to high pressure. In addition, pulsation in pressure in the inlet chamber 302 is reduced, so that vibration in the fuel pipe can be reduced. Thus, a support member of the fuel pipe can be restricted from being loosened or damaged.

(Other Variation)

In the above embodiments, when the plunger 14 upwardly moves, fuel in the inlet chamber 302 can be supplied into the fuel chamber through the communication passage 310. When the plunger 14 downwardly moves, fuel in the fuel chamber can be supplied into the inlet chamber 302 through the communication passage 310.

Alternatively, this structure may be modified to a structure, in which fuel is introduced from the fuel chamber into the inlet chamber through the communication passage when the plunger downwardly moves, and fuel is not supplied from the inlet chamber into the fuel chamber through the communication passage when the plunger upwardly moves.

The plunger may have a straight shape without the step midway lengthwise thereof. In this structure, the diameter of the plunger may be substantially constant in the lengthwise direction of the plunger. In this structure, fuel may be supplied from the inlet chamber into the fuel chamber through the communication passage when the plunger upwardly moves, and fuel may not be introduced from the fuel chamber into the inlet chamber through the communication passage when the plunger downwardly moves.

The fuel chamber may be omitted.

Figure 19:
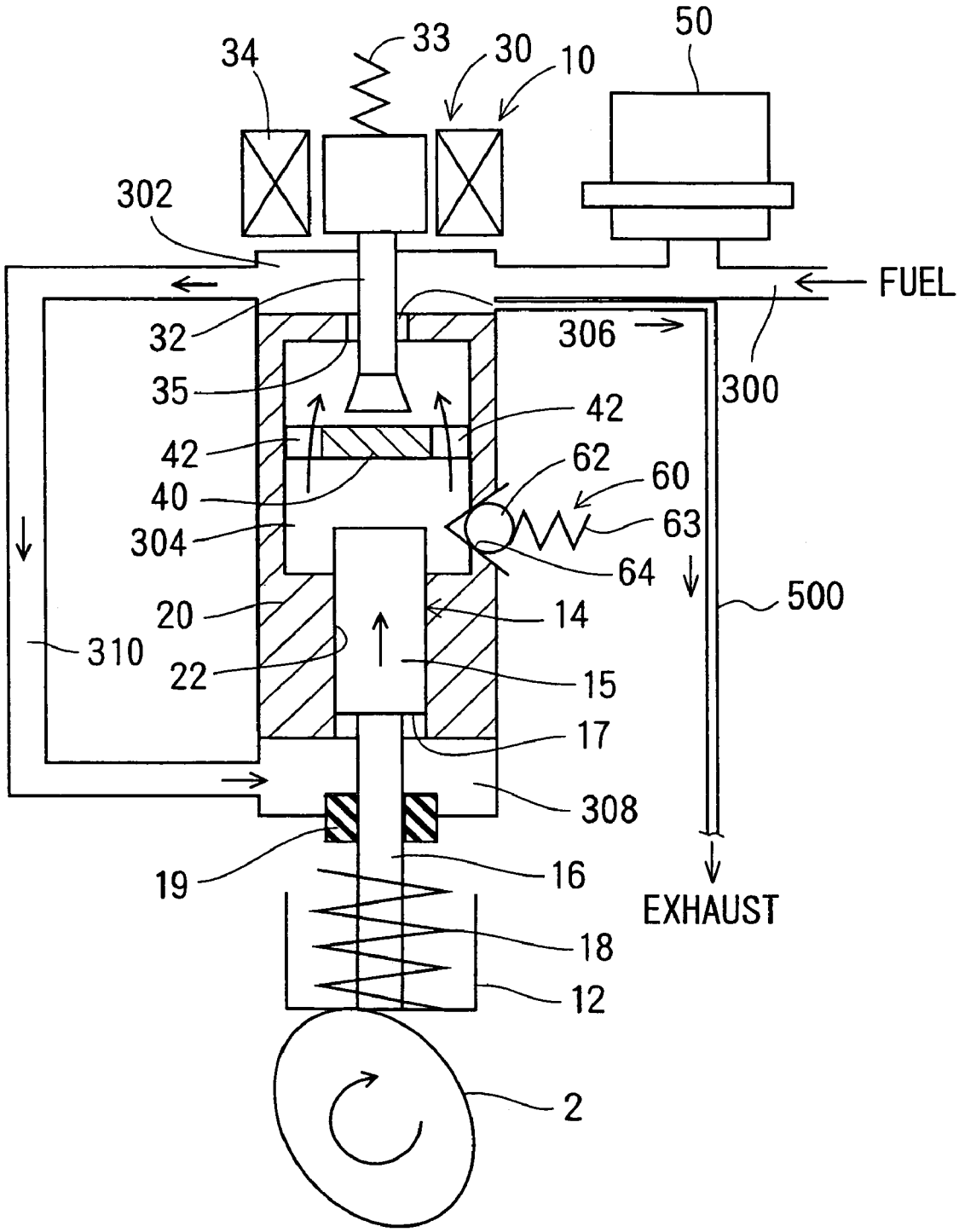
FIG. 19 is a schematic cross sectional side view showing a high pressure pump according to a first variation of the first embodiment.

As shown in FIG. 19, in a first variation of the first embodiment, a discharge passage 500, which is different from the inlet passage 300, may be formed to communicate with the inlet chamber 302. In this structure, fuel may be discharged from the inlet chamber to the outside of the high pressure pump when the plunger upwardly moves.

Figure 20:
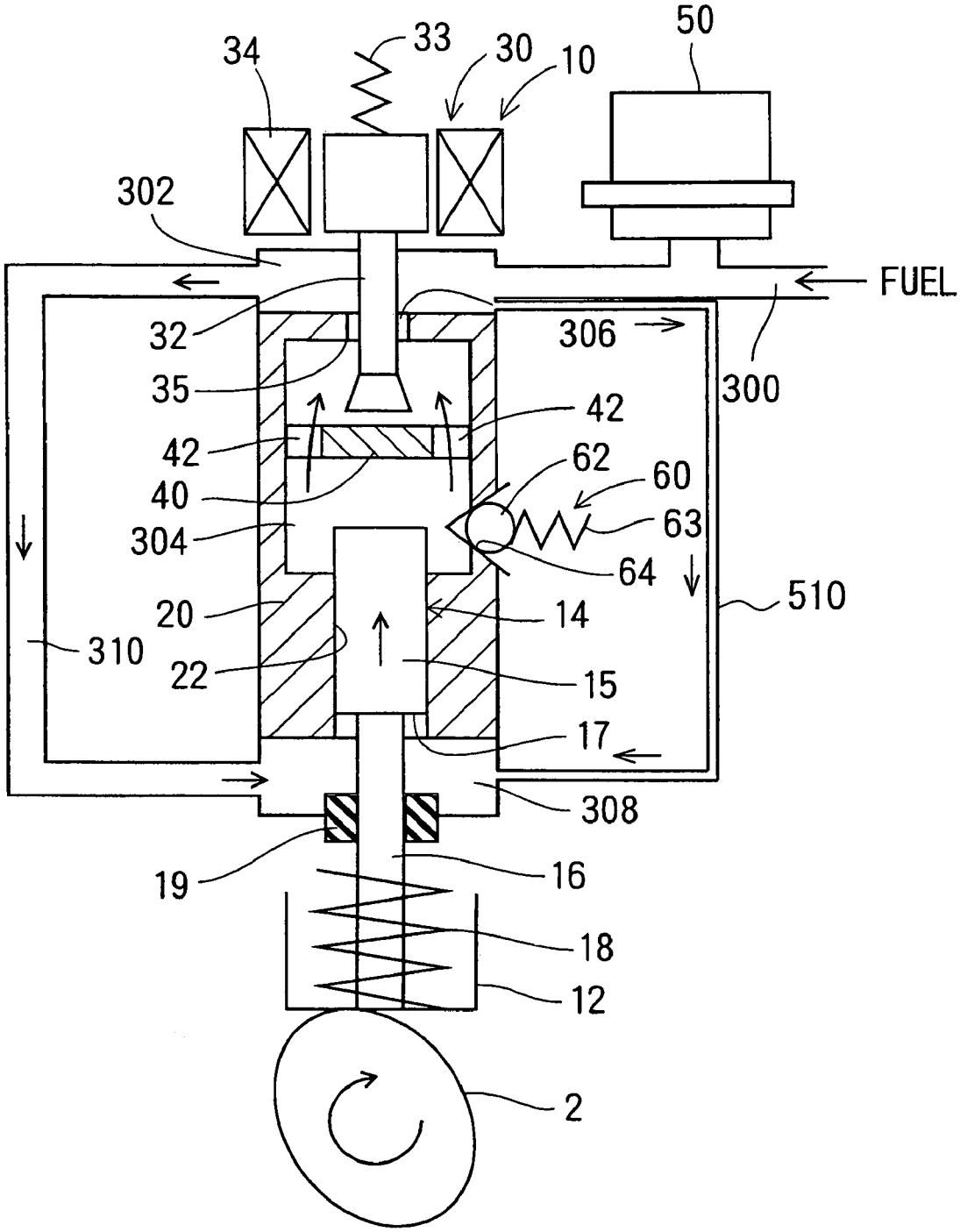
FIG. 20 is a schematic cross sectional side view showing a high pressure pump according to a second variation of the first embodiment.

As shown in FIG. 20, in a second variation of the first embodiment, a discharge passage 510, which is different from the inlet passage 300, may be formed to communicate with the inlet chamber 302. In this structure, fuel may be discharged from the inlet chamber into the fuel chamber through this discharge passage when the plunger upwardly moves.

In these structures in the first and second variations of the first embodiment, pressure in the inlet chamber 302 is restricted from causing pulsation, so that an amount of fuel flowing from the inlet chamber 302 into the compression chamber 304 can be restricted from being insufficient in the intake stroke. In addition, pulsation in pressure in the inlet chamber 302 is reduced, so that vibration in the fuel pipe can be reduced. Thus, a support member of the fuel pipe can be restricted from being loosened or damaged.

Fluid, which is pumped using the high pressure pump, is not limited to fuel. The high pressure pump can pump various kinds of fluid such as gas, two-phased fluid of vapor and liquid, and liquid.

The above embodiments can be combined as appropriate. For example, the annular plate 72 shown in FIG. 3 in the second embodiment can be applied to the structures in the third to thirteenth embodiments. The filter 82 in the third embodiment shown in FIG. 4 can be applied to the structures in the fourth to thirteenth embodiments. The fuel chamber 308 in the fourth embodiment shown in FIG. 5 can be applied to the structures in the fifth to thirteenth embodiments. The control valve 102, the inlet passage 314, and the inlet valve 110 in the fifth embodiment shown in FIG. 6 can be applied to the structures in the sixth to thirteenth embodiments. The control valve 122, the structure of the valve member 126 and the spring 128 in the sixth embodiment shown in FIG. 7 can be applied to the structures in the seventh to thirteenth embodiments. The structure of control valve 132 including the arrangement of the valve member 126 and the spring 128 in the seventh embodiment shown in FIG. 8 can be applied to the structures in the eighth to thirteenth embodiments. Any one of the structures of control valves 142, 152, and 162 including the valve members therein and arrangement of the components shown in FIGS. 9 to 11 can be applied to the structures in the twelfth and thirteenth embodiments. The above combinations are examples. The above structures, components, and arrangements can be variously combined with each other, so that various features and effects can be further produced.

In the above embodiments, the compression chamber 304 has a compression volume. The fuel chamber 308 has a fluid volume. The summation of the compression volume and the fluid volume is substantially constant. Alternatively, the inlet chamber 302 has an inlet volume. The summation of the compression volume, the fluid volume, and the inlet volume is substantially constant.

Specifically, in the intake stroke, when the plunger 14 moves in the cylinder 22 along the drawing direction, the compression volume of the compression chamber 304 increases while the fluid volume of the fuel chamber 308 decreases. In addition, in the compression stroke, when the plunger 14 moves in the cylinder 22 along the pressurizing direction, the compression volume of the compression chamber 304 decreases while the fluid volume of the fuel chamber 308 increases. Thus, the summation of the compression volume and the fluid volume is substantially constant at least in the intake stroke and the compression stroke. Furthermore, the volume of the inlet chamber 302 is substantially constant, regardless of the intake stroke and the compression stroke. Therefore, the summation of the compression volume, the fluid volume, and the inlet volume is substantially constant. Even when the structure of the compression chamber 304, the fuel chamber 308, and the inlet chamber 302 is modified, when the summation of the volumes of the chambers is substantially constant, similar effect can be produced.

Furthermore, various modifications and alternations may be diversely made to the above embodiments without departing from the spirit of the present invention.

What is claimed is:

1. A method for introducing fuel for a high pressure pump, which is configured to draw fuel from a fuel inlet into an inlet chamber and pressurize and discharge the fuel drawn from the inlet chamber into a compression chamber, the high pressure pump comprising:

a plunger that is movable to draw fuel from the inlet chamber into the compression chamber and pressurize the fuel;

a cylinder that movably supports the plunger therein;

a control valve that is configured to control communication between the inlet chamber and the compression chamber to control an amount of discharged fuel;

a fuel chamber that communicates with the inlet chamber through a discharge passage and configured to change in volume in response to movement of the plunger; and a discharge valve that discharges fuel, which is pressurized by the plunger;

the method comprising:

introducing fuel from the fuel chamber into the inlet chamber and drawing the fuel from the inlet chamber into the compression chamber in response to reduction in volume of the fuel chamber when the plunger downwardly moves in an intake stroke;

returning the fuel from the compression chamber into the inlet chamber and partly discharging the fuel, which is returned into the inlet chamber, into the fuel chamber through the discharge passage in response to increase in volume of the fuel chamber when the plunger moves upwardly in a return stroke; and blocking the inlet chamber from the compression chamber using the control valve midway through the return stroke to compress the fuel in the compression chamber in response to upward movement of the plunger in a compression stroke.

2. The method according to claim 1, wherein the fuel chamber is partitioned from the compression chamber by a sliding portion between the plunger and the cylinder.

3. A method for introducing fuel in a high pressure pump, which is configured to draw fuel from a fuel inlet and discharge the fuel through a discharge valve, the method comprising:

introducing fuel from a fuel chamber into an inlet chamber through a discharge passage and drawing the fuel from the inlet chamber into a compression chamber in response to reduction in volume of the fuel chamber when a plunger downwardly moves in a cylinder in an intake stroke;

returning the fuel from the compression chamber into the inlet chamber and partly discharging the fuel into the fuel chamber through the discharge passage in response to increase in volume of the fuel chamber when the plunger upwardly moves in a return stroke; and blocking the inlet chamber from the compression chamber midway through the return stroke to compress the fuel in the compression chamber in response to upward movement of the plunger in a compression stroke.

4. The method according to claim 3, further comprising:

communicating the compression chamber with the inlet chamber and introducing fuel from the fuel inlet into the compression chamber through the inlet chamber in advance of the intake stroke.

5. The method according to claim 4, further comprising:

discharging the fuel compressed in the compression chamber through the discharge valve subsequent to the compression stroke.

6. The method according to claim 3, wherein the fuel chamber is partitioned from the compression chamber by a sliding portion between the plunger and the cylinder.

* * * * *